United States Patent [19]

Meyers

[11] Patent Number: 4,559,959

[45] Date of Patent: Dec. 24, 1985

[54] DISHWASHING APPARATUS

[75] Inventor: Theodore F. Meyers, Troy, Ohio

[73] Assignee: Hobart Corporation, Troy, Ohio

[21] Appl. No.: 434,980

[22] Filed: Oct. 18, 1982

[51] Int. Cl.[4] ..... B08B 3/02; B08B 7/04

[52] U.S. Cl. ..... 134/56 D; 134/57 D; 134/18; 134/25.2; 134/109

[58] Field of Search ..... 134/56 D, 57 D, 58 D, 134/104, 113, 109; 68/12 R

[56] References Cited

U.S. PATENT DOCUMENTS

| | | | |
|---|---|---|---|
| 3,114,253 | 12/1963 | Morey et al. | 68/12 |
| 3,279,481 | 10/1966 | Sones et al. | 134/57 D |
| 3,477,258 | 11/1969 | Walker et al. | 68/12 |
| 3,807,418 | 4/1974 | Jenkins | 134/57 D |
| 3,888,269 | 6/1975 | Bashark | 134/57 D |
| 4,392,891 | 7/1983 | Meyers | 134/104 X |

*Primary Examiner*—Stephen Marcus

*Attorney, Agent, or Firm*—Biebel, French & Nauman

[57] ABSTRACT

A multiple-fill dishwasher and method includes a wash chamber having a sump at the bottom thereof, a remotely controlled inlet valve for supplying cleansing liquid into the sump, a drain for draining liquid and entrained soil from the sump, and a recirculating pump having a spraying system receiving the output thereof for spraying liquid onto soiled ware contained within the chamber. A control circuit controls the valve, drain means, and pump to perform a selected one of a plurality of different cleansing cycles which are automatically selected according to the extent of soil on the ware. An operator-actuated switch for commencing operating of the control circuit, and a chamber for collecting soil particles in a concentrated fashion during liquid recirculation, are also provided. The improvement comprises a sensor responsive to a predetermined particulate soil concentration in the soil collection chamber, the sensor being operable during liquid recirculation to cause the control circuit to select either a cycle designed to wash heavily soiled ware, or a cycle designed to wash lightly soiled ware.

17 Claims, 8 Drawing Figures

O= OPENED
X= CLOSED

| SWITCH | CYCLE | | | | | |
|---|---|---|---|---|---|---|
| | WASH | SANI-CYCLE | RINSE & HOLD | CANCEL CYCLE | DRY HEAT OFF | RESET |
| 180 | X | X | X | X | | O |
| 190 | X | X | | | | O |
| 184 | | | X | X | | O |
| 186 | X | | | | | O |
| 188 | | | | X | | O |
| 190 | | | | | | X |
| 194 | | | | | O | |

DISHWASHING APPARATUS

BACKGROUND OF THE INVENTION

Owners of domestic dishwashers use their machines differently. Some use them as designed and intended to be used by the manufacturer, i.e., by only scraping loose soil from the ware, while at the other extreme, some rinse most of the ware in a sink before putting it in the dishwasher. The latter practice is extremely wasteful of water and is often very wasteful of energy also, if the water used for sink-rinsing has been heated.

For greatest economy, manufacturers as well as conservation-conscious governments and energy producers recommend that partial dish loads be stored in the dishwasher until it is full, and washing be done only after the unit has been fully loaded. It is further suggested that such partial loads be scraped, the dishes located in the machine, and a "Rinse & Hold" detergentless short rinse cycle be run to remove loose soil and flush it down the drain, wherever such a short rinse cycle is provided on the machine.

Various theories of dishwasher operation are prevalent in the industry today. One theory allows all but the very largest soil particles to enter the intake of the recirculating pump and be pumped through wash arms, which necessarily are provided with large nozzle openings to pass this soil without plugging. This recirculation continually pulverizes or macerates the particulate soil, reducing it even finer, and redeposits it on the ware. The end result is a requirement to use several fresh water rinses of the ware, still risking some fine redeposited soil remaining on the surface and in crevices of the ware even after the final rinse. Some more recent units of such design have the capability of collecting some of the soil from the water and holding it in position for disposal to a drain at the end of the cycle segment in which it is collected, rather than recirculating such soil to the end of that part of the cycle.

Another dishwashing theory is to filter very fine soil from the wash solution before it can reach the recirculating pump, thus avoiding recirculation of soil and redeposit problems. This also enables use of finer nozzles in the wash arms, providing greater velocity of water pressure on the ware, although smaller nozzle openings typically mean lower volume of water recirculated. Thus what is gained in one respect is lost in another. A dishwasher operating according to this theory requires additional structure to maintain the filter free to pass sufficient water therethrough for preventing pump starvation or reduction of effectiveness of the pump in carrying out its assigned water recirculating task. This is done by providing rotating backflushing jets inside (on the downstream side of) the filter, to prevent clogging of the fine filter. While such jets are ordinarily unnecessary for those users who manually rinse the ware before placement in the dishwasher, the manufacturer must nonetheless provide for the washing of heavily soiled loads of ware which may have been scraped only lightly. Since meeting worst conditions is a design criteria to market a successful product, the backflushing jets are essential with such a fine filter system. Floating soil is continually kept suspended in the sump water under this theory, and alternately adheres to the outer surface of the filter as a result of pump suction and is pressure back-washed off the filter by the backflushing action. The backflushing has the potential of further reducing particle size, depending on the softness of the soil, increasing the possibility of filter plugging and thus the requirement for greater backflushing action.

In a third theory, the one to which the present applicant subscribes as preferred, the soil is collected from the sump water without soil recirculation through the pump. Collection is accomplished as rapidly as possible, and soil is stored for later removal to drain at the next emptying of the sump. This eliminates the soil pulverizing and redeposit problem present in the first-mentioned washing theory and avoids the second theory's necessity of continually backflushing the main pump filter in order to keep operating effectively in conditions of heavily soiled ware. A system according to this third theory is disclosed in copending U.S. Pat. No. 4,392,891, issued July 12, 1983 to Meyers.

Most home dishwashers are provided with several dishwashing cycles from which the operator can choose to wash a specific load of dishes. Some common examples of cycle names are HEAVY SOIL for grossly soiled, scraped-only dishes, NORMAL WASH for moderately soiled dishes (some of which may have already been pre-rinsed in a RINSE & HOLD cycle), and LIGHT SOIL where little or no particulate soil is present on the ware. Cost of the buttons and controls for providing the several cycles is relatively insignificant in terms of the cost of washing dishes during the normal ten-year life of a dishwasher. A greater cost, in terms of consumption of hot water (the most typical supply temperature being 140° F. (60° C.) in the United States.) is the ever-increasing cost and waste of energy in those instances where a longer cycle is selected by the operator than what is necessary under the specific conditions of a given load of dishes. Naturally, of the three most common cycles named, a HEAVY SOIL cycle is the longest in terms of time, greatest in the consumption of water and detergent and consequently the most energy intensive. Anytime a cycle is selected which is designed for a worse condition than actually present, waste will occur. And, any time a less-than-required cycle is chosen, risk is present of inadequately washing the ware. Thus, selection of the correct cycle presents somewhat of a problem to the operator, and can either be wasteful or provide inadequate results if the correct cycle (according to the soil conditions present) is not chosen.

It is not new to seek to automate cycle selection by providing the operator with only a single WASH button and having the dishwasher automatically determine the conditions of length of time of cycle, repetition of portions of a cycle, etc. in response to soil conditions. This is the intent of U.S. Pat. No. 3,888,269. Further, this goal has been discussed in meetings of home appliance designers and considered in patents, and other publications. Designers of clothes washers have also considered a similar problem and offered solutions thereto. Exemplary of such clothes washer efforts are U.S. Pat. Nos. 3,477,258; 3,114,253 and 3,279,481. Further, in the dishwasher art, while not providing for automatic cycle selection as such, U.S. Pat. No. 3,807,418 teaches that an additional rinse can be added at the end of a complete cycle if soil particles remain in the drain line of the dishwasher at the time of the final fresh water rinse.

What has been lacking in the foregoing prior art is the capability to sense a condition of particulate soil which is truly and closely indicative of the requirements to wash a given load, regardless whether the dishes are heavily, moderately or lightly soiled. The goal has been known, and attempts have been made to accomplish it. Yet no domestic dishwasher known to be on the market is capable of accurately sensing and predicting the amount of time, detergent and water to devote to a given load of dishes, and automatically operating according to those sensed conditions. This is due in part to the difficulty in determining actual soil conditions until the particulate soil is removed from the ware, descends into the sump, and is concentrated in a location where its quantity or mass can be indicated by a sensor. It is not enough to sense turbidity as in U.S. Pat. No. 3,888,269, since detergents, soil foam, stains from coffee, etc. are all capable of providing indications of turbidity while having no relation to the true soil conditions of the sump water. Nor is it enough to sense in one small area of the sump when the soil is distributed throughout the sump. Further, it is not truly effective to sense particulate soil only at the end of the final rinse and add an extra rinse, if the dishwasher is to be operated according to the aforementioned preferred theory.

What is required, therefore, is quickly to collect or concentrate particulate soil, the greatest problem in redeposition, determine the volume of particles in the concentration near the beginning of the cycle and then control the dishwasher accordingly.

SUMMARY OF THE INVENTION

A multiple-fill dishwasher includes a wash chamber having a sump at the bottom thereof, means including a remotely controlled inlet valve for supplying cleansing liquid into the sump, and means for draining liquid and entrained soil from the sump. A recirculating pump has an inlet adjacent the bottom of the sump and a spraying system receiving the output of the pump for spraying cleansing liquid onto soiled ware contained within the chamber. A control means is connected so as to control the valve, drain means and pump to perform a selected one of a plurality of different cleansing cycles which are automatically selected according to the extent of soil on the ware to be washed. An operator-actuated switch means for commencing operating of the control means, and means for collecting soil particles in concentrated fashion during recirculation of the cleansing liquid, are provided.

The improvement in the dishwasher includes a sensor means responsive to a predetermined particulate soil concentration in the soil collecting means. A means operated by the sensor means during liquid recirculation causes the control means to select either a cycle designed to wash heavily soiled ware, or a cycle designed to wash lightly soiled ware, depending upon particulate soil concentration.

The dishwasher may include a fine-mesh filter, and a conduit through which liquid is circulated through the filter. The sensor senses an impeded or unimpeded flow condition through the filter to select the cycles for heavily or lightly soiled ware.

The dishwasher may further include a soil collection chamber, into which liquid is circulated by the conduit, and out of which the liquid must pass through the filter. A collecton pump having an inlet adjacent the bottom of the sump is provided for pumping liquid into the conduit, so that the means for collecting soil particles is independent from the recirculating pump and the spraying system.

The sensor means may be responsive to particulate soil buildup in the soil collection chamber. The sensor senses a pressure variation within the collection chamber in order to select the cycles for heavily or lightly soiled ware.

Accordingly, it is an object of the present invention to provide a dishwasher which includes a wash chamber having a sump, an inlet valve, means for draining the sump, a recirculating pump and spraying system, control means, an operator-actuated switch means and a means for collecting soil particles wherein the dishwasher will automatically select a proper cycle for the ware to be washed, according to the extent of soil thereon; to provide such a dishwasher that will automatically eliminate unneeded portions from the dishwasher cycle, thereby conserving water and energy; to provide such a dishwasher that will automatically insure the cleanliness of the ware to be washed, by adding additional portions to the dishwasher cycle when needed; and to provide such a dishwasher that will collect particulate soil from the liquid therein, respond to a certain concentration thereof, and control the dishwasher accordingly.

Other objects and advantages of the invention will be apparent from the following description, the accompanying drawings, and the appended claims.

DETAILED DESCRIPTION OF THE PREFERRED EMBODIMENT

Figure 1:
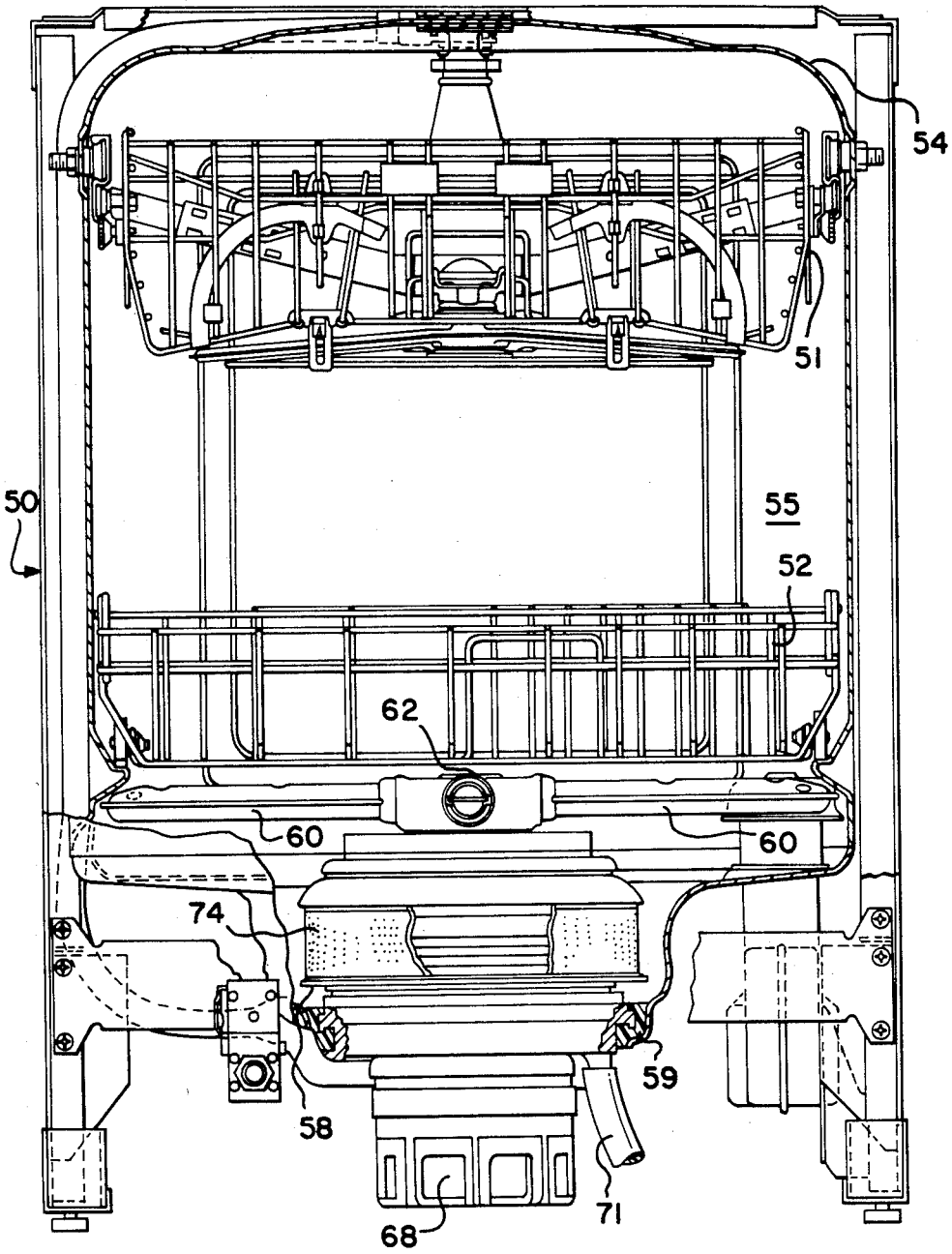
FIG. 1 is a partial cross-section view of the dishwasher of the present invention, with the front of the sump and a portion of the main filter screen being broken away, and the door removed.

As shown in FIG. 1, a domestic dishwasher 50 includes conventional upper and lower racks 51 and 52 for supporting food ware, such as cups, saucers, plates and silverware, within a tank 54. Tank 54 forms the rear, bottom, sides and top of a wash chamber 55, with the front of chamber 55 defined by a door (not shown) which closes tank 54 during washing and rinsing of the food ware.

A sump 56 in the bottom of tank 54 comprises part of wash chamber 55, and a pump housing 58 is positioned within an opening formed in sump 56. A fluid seal is formed between sump 56 and housing 58 by an annular gasket 59, fitted about housing 58. Primary reaction spray arms 60 having a plurality of spray orifices (not shown) defined therein are supported on a fixed shaft 62 at the top of housing 58.

Figure 2:
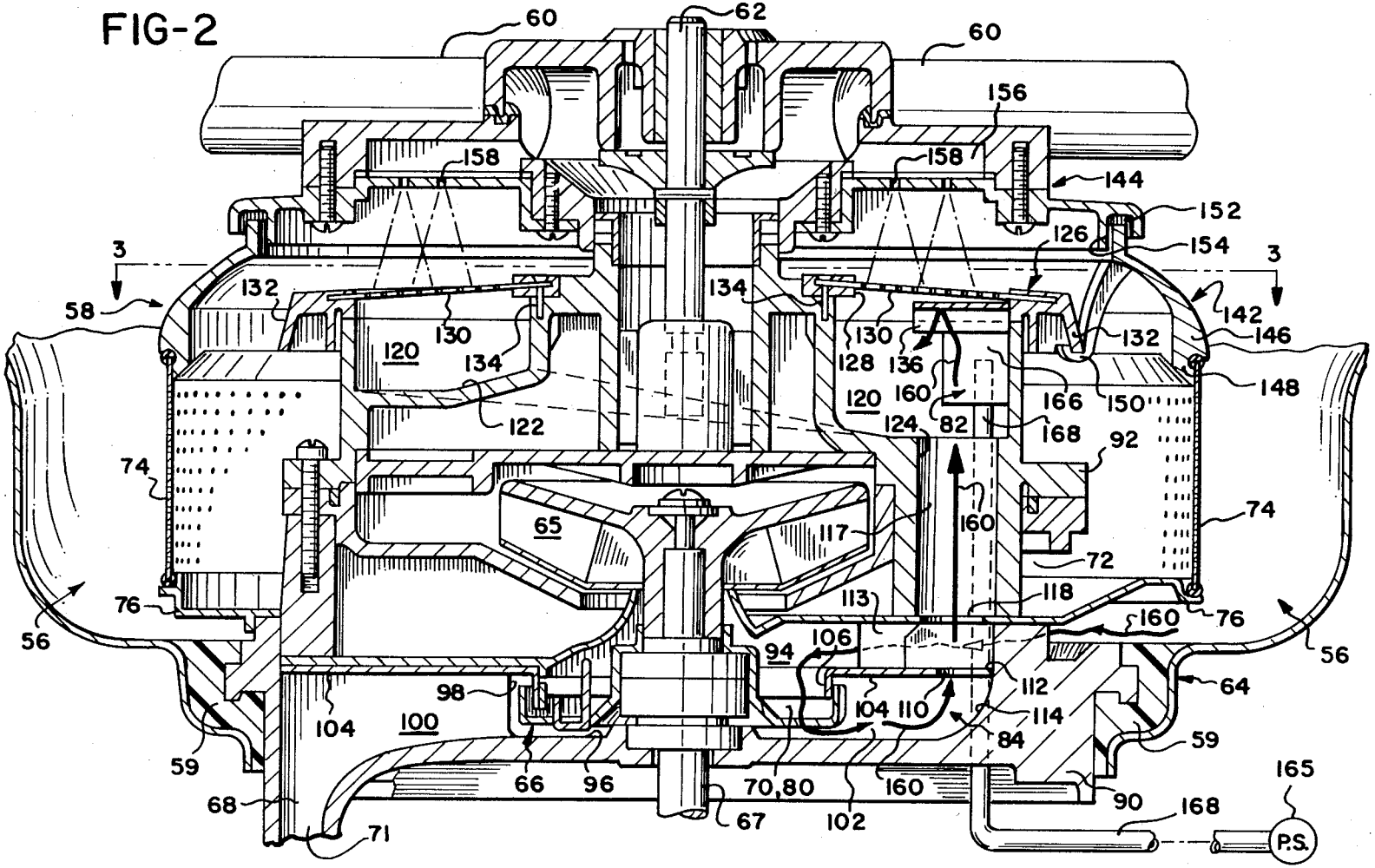
FIG. 2 is a sectional view of the key pump, filtering and soil collecting elements found in the sump area of the dishwasher.

As shown in FIGS. 1 and 2, the pump housing 58 encloses both a recirculating pump impeller 65 and a drain pump impeller 66. Recirculating pump 65 and drain pump 66 are fixed to a drive shaft 67, driven by a reversible motor 68 mounted beneath sump 56. Drain pump 66 is part of a drain system which has an inlet opening 70 in the bottom of sump 56 for pumping fluid from the dishwasher 50, through a drain line 71, and into a suitable conventional drain (not shown).

In the embodiment shown in FIGS. 1 and 2, a primary spraying system includes recirculating pump inlet 72, located in sump 56. Inlet 72 is protected by a main filter screen 74 supported by the outer edge of a circular plate 76 forming a part of pump housing 58 to prevent large food soil particles from entering the recirculating pump 65 and blocking or clogging the spray orifices in arms 60.

A means for collecting soil particles, independent of the primary spraying system, consists in part of a collection inlet 80, which is common with drain pump inlet 70, a soil collector body 82 integral with pump housing 58, and a fluid inlet conduit 84 extending from the inlet 80 through the collector body 82. Collection inlet 80 is located substantially at the bottom of sump 56 to expedite removal of food soil since it tends to precipitate out of the circulating fluid toward the sump at the bottom of the wash chamber 55.

The fluid inlet conduit 84 is contained within the pump housing 58. Pump housing 58 includes a lower housing base plate 90 and an upper section 92. Base plate 90 defines a passageway 94 which comprises a continuation of the sump 56 beneath the upper section 92 to the circuit inlet 80. The drain pump 66, which is contained within the base plate 90, includes a circular pump recess 96 defined by wall 98, a drain channel 100, and a soil collector channel 102. The drain channel 100 forms a part of the drain line 71 and the collector channel 102 forms a part of the fluid inlet conduit 84.

Drain impeller 66 is mounted within recess 96, and is covered by a cover plate 104 having an opening 106 concentric with the impeller 66 which comprises the soil collecting inlet 80 and drain system inlet 70. Cover plate 104 further defines a circular cut-out 110 above collector channel 102 which forms a nozzle 112 with the curved wall 114 of the base plate 90. Nozzle 112 is partially shielded from fluid flowing along the passageway 94 by a shield 113 and base plate 90.

A fluid channel 117, defined in upper section 92 of housing 58, extends downwardly from the collector body 82 to an opening 118 in plate 76 at a point slightly above the nozzle 112. A gap in the fluid inlet conduit 84 is thereby formed above the nozzle 112, placing conduit 84 in fluid communication with passageway 94 at that point.

The collector body 82 includes an annular collection chamber 120 defined within the upper section 92 of housing 58. Collection chamber 120 includes a floor 122 which slopes toward a fluid inlet opening 124 to facilitate draining the chamber 120. Opening 124 communicates with the upper end of fluid channel 117.

The collector body 82 also includes a fine filter screen 126 which covers a fluid outlet 128 that is generally annular in shape and concentric with the pump housing 58. Screen 126 preferably includes a nylon mesh 130 extending between and molded into a frame 132 having support spokes 133. Mesh 130 preferably comprises substantially square openings 0.0106 inches (0.0289 cm) on a side and is 44% open. Screen 126 is retained by screws 134 to the top of the pump housing 58.

A deflector plate 136 is also molded into the screen 126 and is positioned above the fluid inlet opening 124 in order to deflect fluid entering the collector body from the fluid channel 117. Plate 136 is inclined relative to the screen 126 so that fluid impinging upon its underside is deflected about the soil collection chamber 120.

As shown in FIG. 2, the fluid outlet 128 is enclosed by a shroud 142 which has a rotatable portion attached to spray arms 60 and a fixed portion attached to the main screen 74. Shroud 142 comprises a disc-shaped inner member 144 and an annular outer member 146. Outer member 146 is arcuate in section and includes a lower lip 148 which engages the main screen 74, and prongs 150 depending downwardly to engage the periphery of the frame 132.

The inner member 144 is integral with the spray arms 60 and its outer periphery defines an inverted, U-shaped channel 152 which engages an upper rim 154 of the outer member 146 to form a labyrinth seal. The labyrinth seal permits rotation of the inner member 144 with respect to the outer member 146 during operation of the primary spray means. Inner member 144 also includes conduits 156 having downward opening orifices 158 located above filter screen 126, and in fluid communication with the spray arms 60 and hence recirculating pump 65. Orifices 158 form spray jets to clean the filter screen 126 and promote flushing of the soil collection chamber 120.

The operation of the dishwasher is described below. When the dishwasher 50 is operated in a washing or rinsing cycle, the primary spray means operates in a fluid recirculating mode in which it recirculates and sprays fluid from the sump 56 onto the food ware. The recirculating pump impeller 65 is activated by the drive motor 68 so that the recirculating pump 65 draws fluid through the recirculating pump inlet 72 and pumps it up through the pump housing 58 to the spray arms 60. Fluid entering the spray arms 60 exits holes formed in the arms (not shown) and is sprayed upon the food ware in a manner well-known in the art. The fluid entering the recirculating pump inlet 72 from the sump 56 is strained through the main filter screen 74 so that the larger food soil remains within the sump and only filtered fluid is pumped by the impeller 65 to the spray arms 60.

At the same time the recirculating pump 65 is operating in the recirculating mode, the drain pump impeller 66 is operating in a soil collecting mode. The drain pump impeller 66 rotates in a forward mode on the drive shaft 67 with the recirculating pump impeller 65, thereby pumping fluid flowing from sump 56 through soil collecting circuit inlet 80 along the soil collecting channel 102 of the fluid inlet conduit 84. The fluid path is shown by arrows 160 in FIG. 2. Fluid pumped along the fluid inlet conduit 84 is accelerated as it passes through nozzle 112 and is directed upwardly along the fluid channel 117, through the fluid inlet opening 124, and into the soil collection chamber 120 of the soil collector body 82.

As the fluid is pumped along fluid inlet conduit 84, the swirling action of the fluid between the outer periphery of the drain impeller 66 and the wall 98 of the pump recess 96 creates a slight negative or zero pressure in the drain channel 100 which prevents fluid from flowing into the channel 100 during the soil collecting mode. Thus, the geometry of the drain pump impeller 66 and the pump recess 96 act to form a valve which prevents flow of fluid through the drain line 71 during the soil collecting mode. Of course, it will be recognized that in the alternative drain line 71 may include a controllable valve suitable for preventing flow through drain line 71 when the dishwasher 50 is operated in the recirculating mode.

The relatively high pressure and high velocity fluid stream exiting from the nozzle 112 and traveling upwardly along the common fluid channel 117 tends to draw along with it fluid and suspended food soil present in the passageway 94 in the immediate region surrounding the shield 113 which partially encloses the gap. The nozzle 112 thus acts as an injection pump by entraining fluid and food soil from the sump 56 within a stream of fluid entering the soil collector body 82.

Once the fluid and suspended food soil enters the soil collector body 82, it impinges upon the deflector plate 136 and is diverted from its substantially vertical path to a substantially horizontal path around the circular soil collection chamber 120. As the collection chamber 120 fills with fluid and food soil, the fluid exits up through the fluid outlet 128 of the soil collector 82 and is strained through the screen 126, thereby leaving the food soil within the collection chamber. The strained fluid, now substantially free of soil particles, travels over the top of the screen 126 and downwardly beneath the shroud 142. The fluid is deposited in the recirculating pump inlet 72 between the upper section 92 of the pump housing 58 and the main filter screen 74. Food soil is retained within the chamber 120 since the relatively high velocity stream of fluid entering the inlet 124 prevents reverse flow of soil through the inlet.

During the soil collecting mode, a portion of the fluid pumped through the recirculating pump 65 enters the conduits 156 formed in the inner member 144, and communicating with the primary spray arms 60, where it passes through the orifices 158 and is directed upon the upper surface of the screen 126. As the primary spray arms 60 rotate during the recirculating mode, the spray jets from the orifices 158 traverse the nylon mesh 130 of the screen 126 to backflush the mesh 130. This spray, along with the swirling action caused by deflection plate 136, tends to prevent clogging of the mesh 130 by food soil retained within the soil collection chamber 120, so long as the amount of soil therein stays essentially below a predetermined concentration as will be discussed below. In addition, the inner member 144 and shroud 142 prevent large food soil particles from getting onto the screen 130 during the recirculating mode.

When the dishwasher 50 is operated in a drain cycle, recirculating pump 65 operates in a fluid draining mode. In this mode, the pump motor 68 reverses the direction of its rotation of the drive shaft 67, thereby causing the circulating pump impeller 65 and drain pump impeller 66 to reverse rotation. With regard to the recirculating pump impeller 65, reverse rotation causes some fluid to be pumped from the pump inlet 72 toward the primary spray arms 60 and conduits 156 within the inner member 144 of the shroud 142. This fluid passes through orifices 158, through the nylon mesh 130, and into collection chamber 120.

Due to the geometry of the drain pump recess 96 and drain pump impeller 66, however, reverse rotation of the drain impeller 66 causes the fluid entering the drain pump inlet 70 to be swirled in an opposite direction and pumped along the drain channel 100 to the drain line 71 and ultimately to a drain. Since there no longer is a relatively high-velocity, high pressure stream of fluid flowing upwardly along the fluid channel 117, there no longer is a high pressure stream of fluid entering the collection chamber 120 to prevent fluid flow downwardly through the fluid inlet opening 124. Accordingly, the soil collecting circuit operates in a soil discharging mode as the fluid from orifices 158 and the retained food soil within chamber 120 flow across the downwardly sloping floor 122 and into the fluid inlet opening 124.

Fluid and food soil continue to flow downwardly along the fluid channel 117 and enter the gap between the fluid channel and the nozzle 112. At this point, the fluid and food soil either continue to flow downwardly through the nozzle 112 and along the soil collecting channel 102 to the drain channel 100, or the fluid and food soil flow along the plate 104 and re-enter the drain pump 66 through the drain pump inlet 70, passing through to the drain channel 100.

It will be recognized that as the dishwasher 50 is operated in a soil collecting mode, the collection of food soil within collection chamber 120 and the passage of fluid through the mesh 130 causes the mesh to become partially clogged by soil particles despite the backflushing of mesh 130 provided by orifices 158. Since the fluid flow into chamber 120 is substantially constant during this mode, however, the reduction in available area along mesh 130 for fluid flow out of chamber 120 will impede the flow therethrough, causing fluid back pressure therein to increase.

Figures 3, 5:
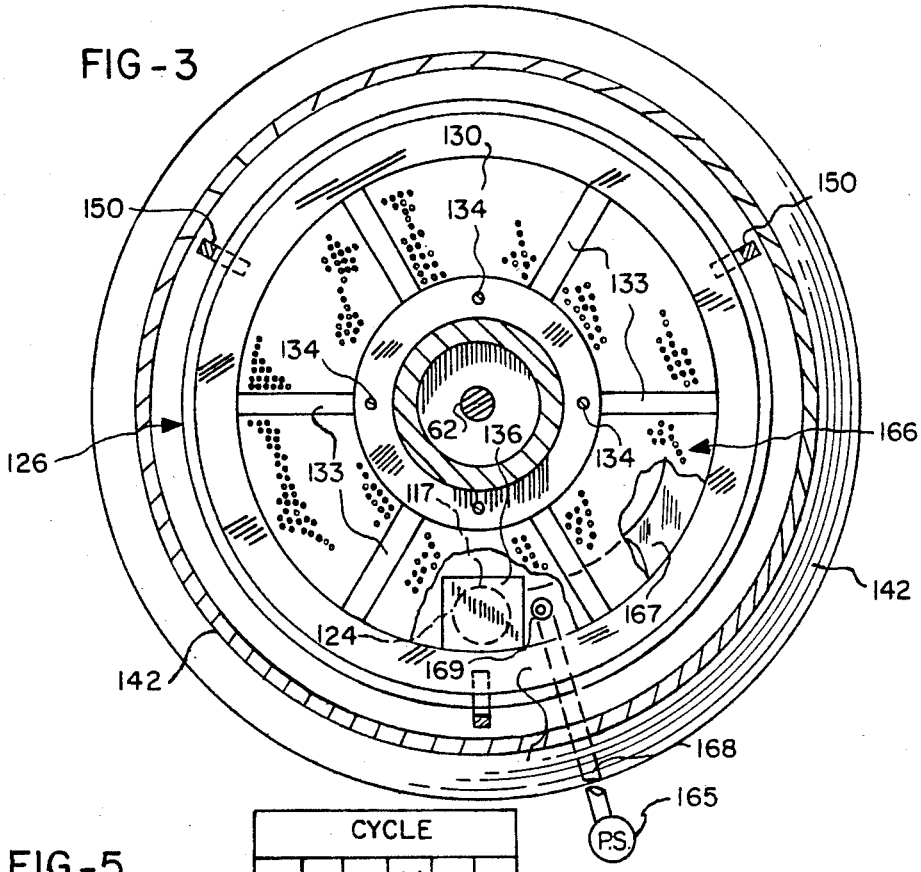
FIG. 3 is a sectional view taken generally along line 3—3 in FIG. 2.
FIG. 5 is a table showing the operation of the operator-actuated switch means.

As shown in FIGS. 2 and 3, the improvement of the present invention includes a sensor means comprising a single-pole, double-throw pressure switch 165 mounted outside of wash chamber 55. A pressure chamber 166 is mounted within collection chamber 120 adjacent deflector plate 136, partially formed by an inner side wall and two end walls. An outer side wall is formed by upper section 92 of housing 58, and a top cover 167 adjacent mesh 130 encloses the top of chamber 166. The bottom of chamber 166 is open and in free fluid communication with soil collection chamber 120. A length of flexible tubing 168 has an upper end 169 thereof disposed within chamber 166 substantially near the top cover 167. Tubing 168 extends downwardly from chamber 166, passing through chamber 120, floor 122, plate 76, and base plate 90, and communicates at a lower end thereof outside wash chamber 55 with pressure switch 165.

As soil particles are collected within collection chamber 120 and fluid pressure therein increases, the fluid level in the lower portion of pressure chamber 166 rises, compressing the air contained within the upper portion of chamber 166. Air pressure within chamber 166 and tube 168 are thus increased, activating pressure switch 165. Similarly, as fluid pressure within collection chamber 120 is decreased, fluid level within pressure chamber 166 drops. Air pressure within chamber 166 and tube 168 is lowered, deactivating switch 165. Consequently, switch 165 is effectively responsive to the degree of fluid flow impedence through filter mesh 130.

It will be recognized that upper end 169 of tube 168 must be located sufficiently close to top cover 167 of chamber 166 so that the fluid level therein will not rise above upper end 169 when fluid pressure within collection chamber 120 is high.

Figure 4:
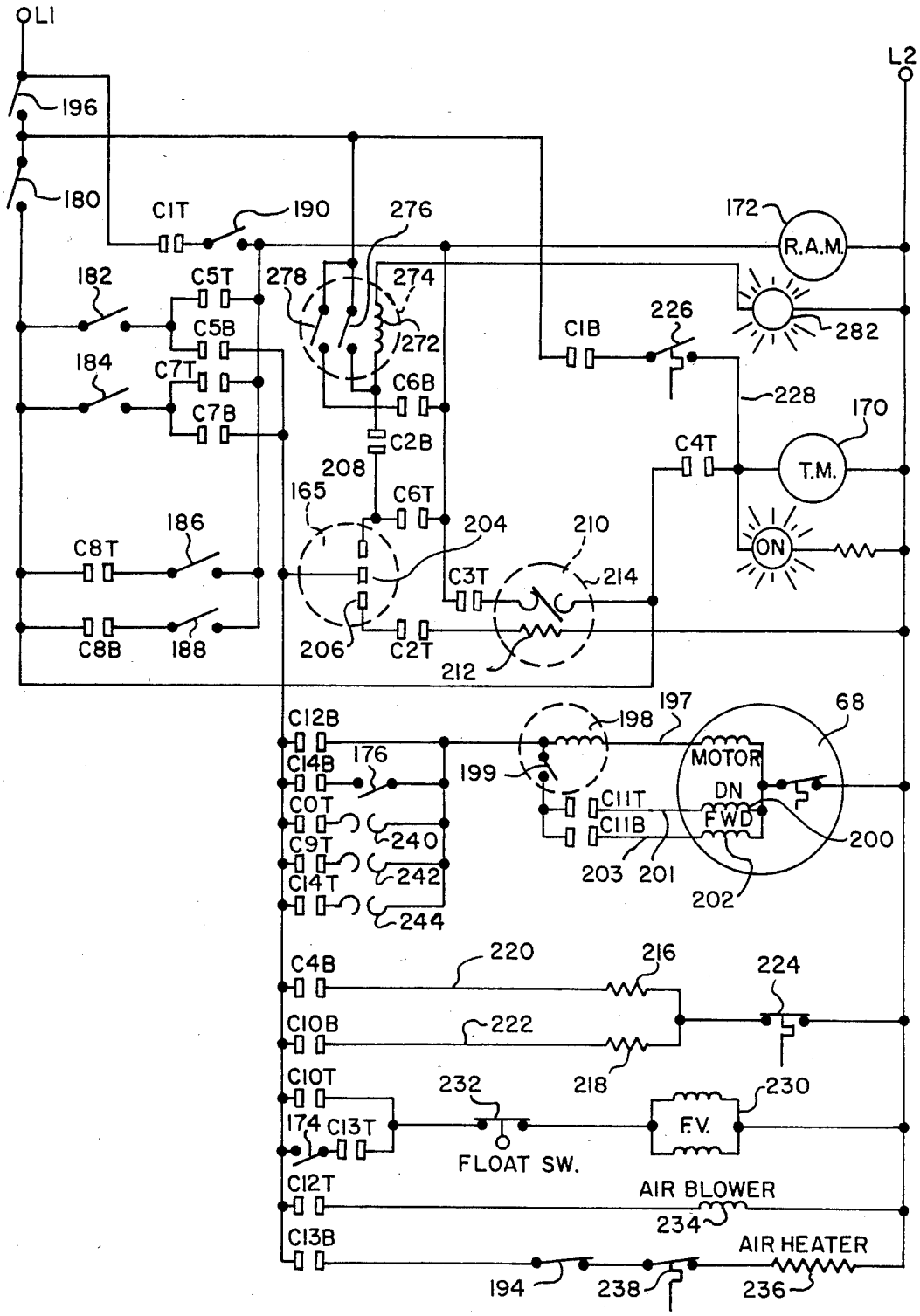
FIG. 4 is a schematic wiring diagram of the control means.
Figure 6:
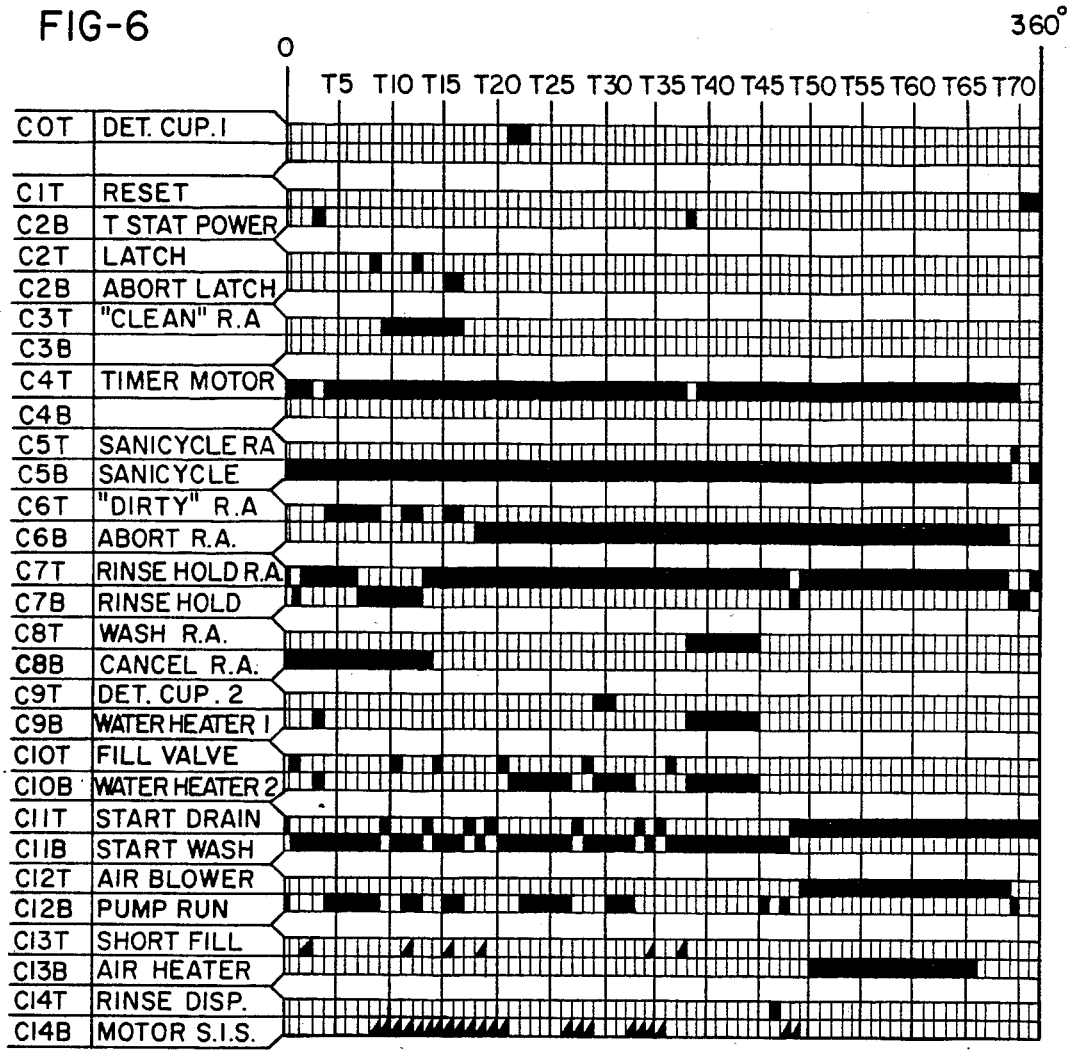
FIG. 6 is a cycle chart illustrating the sequential operation of the timer.
Figure 7:
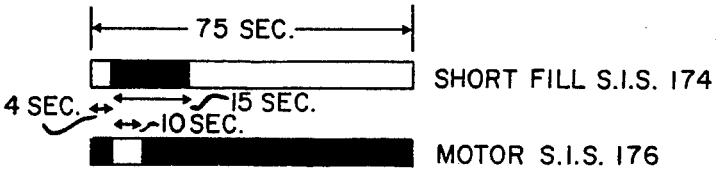
FIG. 7 is a diagram illustrating the operation of the sub-interval switches.

Suitable wiring is provided (not shown) to connect switch 165 to a dishwasher control means, shown schematically in FIG. 4. The control means is energized from a suitable 60-cycle power source connected with terminals L1 and L2. A $14\frac{1}{2}$ cam, 72-increment timer includes a timer motor 170 for driving the timer at a rate of 75 seconds per increment, and a rapid advance motor 172 for driving the timer at a rate of one second per increment. Cam switches C0T–C14T and C1B–C14B of the timer control the various components of the dishwasher 50 in their proper sequence, as illustrated in FIG. 6. The timer further includes a pair of sub-increment switches 174 and 176, connected in series with cam switches C13T and C14B, respectively, and operative as indicated in FIG. 7.

An operator-actuated switch means (not shown) is mounted to the exterior of the dishwasher 50 so as to enable the operator to select one of three dishwasher cycles, "Wash", "Sani Cycle", and "Rinse & Hold", as well as to cancel an already selected and partially performed cycle or to select the use of unheated rather than heated air in the drying process. The switch means is constructed so as to control line switches 180, 182, 184, 186, 188, 190, and 194 in the manner indicated by the table in FIG. 5, according to the cycle selected by the dishwasher operator.

Upon the opening of a latch (not shown) disposed on the door of dishwasher 50 so as to permit opening of the door, an actuator connected to the latch operates the switch means so as to control the line switches as shown in the "Reset" column of FIG. 5. Switch 190 is closed, thereby allowing rapid advance motor 172 to be energized through cam switch C1T so as to move the timer through the last several timer increments, shown in FIG. 6, in preparation for the start of a new cycle. An interlock switch 196 is connected between terminal L1 and switch 180, also associated with the door latch of dishwasher 50, breaking the power circuit when the door is opened.

Lead 197 is the primary power lead connected to motor 68 for energizing motor 68 so as to drive pumps 65 and 66 for either washing of the ware or draining of sump 56. The coil of a starting relay 198 is connected to lead 197. Upon energization of motor 68, as a result of lock rotor (rotor speed), a high current is produced in the coil of relay 198, thereby closing its contact 199. Depending upon the increment position of the timer, either cam switch C11T or C11B will be closed. If cam switch C11T is closed, closing of contact 199 will cause starting coil 200 of motor 68 to be energized through lead 201, thereby starting motor 68 in a direction so as to drive pumps 65 and 66 such that pump 66 forces fluid into drain channel 100. If cam switch C11B is closed, closing of contact 199 will cause starting coil 202 of motor 68 to be energized through lead 203. Motor 68 will then be started in an opposite direction so as to drive pump 65 for circulation of fluid through spray arms 60 and to drive pump 66 for circulation of fluid into fluid inlet conduit 84. Upon starting of motor 68, the current in lead 197 will drop, allowing contact 199 of relay 198 to open, de-energizing starting coil 200 or 202.

Motor 68 may be energized through either cam switch C12B, or cam switch C14B and sub-interval switch 176. As indicated in FIG. 7, sub-interval switch 176 is normally closed, but opens to provide a ten-second de-energized period near the beginning of a timer increment. Switch 176 and cam switch C14B are used whenever the direction of motor 68 is reversed, to permit the motor 68 to coast to a stop before changing direction.

Pressure switch 165 (shown in a neutral position for clarity) is normally disposed with contact member 204 in contact with terminal 206. At a predetermined pressure within collection chamber 120, switch 165 is activated and member 204 contacts terminal 208. Member 204 returns to its normal position when collection chamber pressure is reduced below the predetermined level.

A thermal relay switch 210 having a heater 212 and a normally open bi-metal switch 214 is provided wherein energization of heater 212 for approximately 75 seconds will warp switch 214 to a closed position. Upon deenergization of heater 212, the switch 214, due to its thermal inertia, will remain closed for at least 15 seconds.

Water heater 216 and water heater 218 are connected in parallel by leads 220 and 222, respectively, so that by selecting a single heater or a combination of heaters 216 and 218, different heating levels may be obtained. A normally-closed thermostatic switch 224 is connected to heaters 216 and 218 to protect the heaters against possible overheating.

A normally-open thermostatic switch 226 is connected by lead 228 to timer motor 170 so that by opening cam switch C4T and closing cam switch C1B, advance of the dishwasher cycle may be made dependent upon temperature within wash chamber 55, rather than time, for some portion of the cycle.

Control means for a fill valve 230 is provided for controlling the inlet of water into the wash chamber 55. A float switch is connected to control fill valve means 230 to prevent overfilling of chamber 55. Fill valve 230 is energized through either cam switch C10T or cam switch C13T and sub-increment switch 174. As shown in FIG. 7, switch 174 permits fill valve 230 to open for a 15-second period rather than the full 75-second increment. Thus, by following a 75-second energization of valve 230 by a 15-second energization, a 90-second period may be obtained.

An air blower 234 is included to facilitate the drying of ware within chamber 55, and an air heater 236 is provided for heating the air to be circulated by blower 234, further facilitating drying of the ware. A normally-closed thermostatic switch 238 is connected to heater 236 to protect against overheating. Further, line switch 194 is connected to heater 236 to permit the operator to select unheated air for drying of the ware.

A pair of detergent dispensing cups (not shown) are mounted to the inner surface of the door of dishwasher 50. Each cup has a lid latchable in a closed position with spring opening means for opening the lids when latches 240 and 242 are released. Each latch 240 and 242 comprises a bi-metal strip engageable with a lid.

As shown in FIG. 3, latch 240 may be energized through cam switch C0T, while latch 242 may be energized through cam switch C9T. Upon energization, the bi-metal latch 240 or 242 is warped away from its engaged lid, thereby releasing the lid and allowing it to open. Detergent contained within the cup is thus introduced into wash chamber 55. A dispenser for addition of a rinse agent to wash chamber 55 is also provided, and is activated by a bi-metal actuator 244, energized through cam switch C14T.

The three selectable dishwasher cycles, "Wash", "Sani Cycle", and "Rinse & Hold", generally consist of various combinations of several operations. Sump 56 may be filled or drained. A wash operation includes the circulation of water with detergent in wash chamber 55. The circulation of water without detergent may be either a prewash or a rinse, and the dry operation includes the circulation of either heated or unheated air.

Additionally, the "Cancel Cycle" operation terminates upon selection thereof whichever cycle the dishwasher 50 may be performing, and resets the dishwasher 50 for starting of another cycle.

Two primary cam switches, C5 and C7, are used to control the four cycles. "Sani Cycle" is the lengthiest in time, including one to three prewashes, two washes, a rinse, and a dry, with the necessary associated fills and drains between each operation. The rinse includes a heating period for the rinse water, with period length determined by thermostat 226. "Wash" is identical to "Sani Cycle" except that the heating period for the rinse water is eliminated by energizing rapid advance motor 172 by cam switch C8T and line switch 186, shown at timer increment T39 in FIG. 6. "Rinse & Hold" includes only one or two prewashes, with the remaining operations bypassed by energizing rapid advance motor 172 at increment T14 by cam switch C7T and line switch 184. "Cancel Cycle" will cause all operations to be bypassed, and is effected by energizing rapid advance motor 172 first at increment T1 by cam switch C8B and line switch 188, and then at increment T14 by cam switch C7T and line switch 184.

The exact number of prewashes in each cycle is controlled by pressure switch 165 and is dependent upon the soil concentration level within soil collection chamber 120. "Wash", "Sani-Cycle" and "Rinse & Hold" all provide for at least one prewash per cycle, with a maximum of three for "Wash" and "Sani Cycle", and two for "Rinse & Hold".

Figure 8:
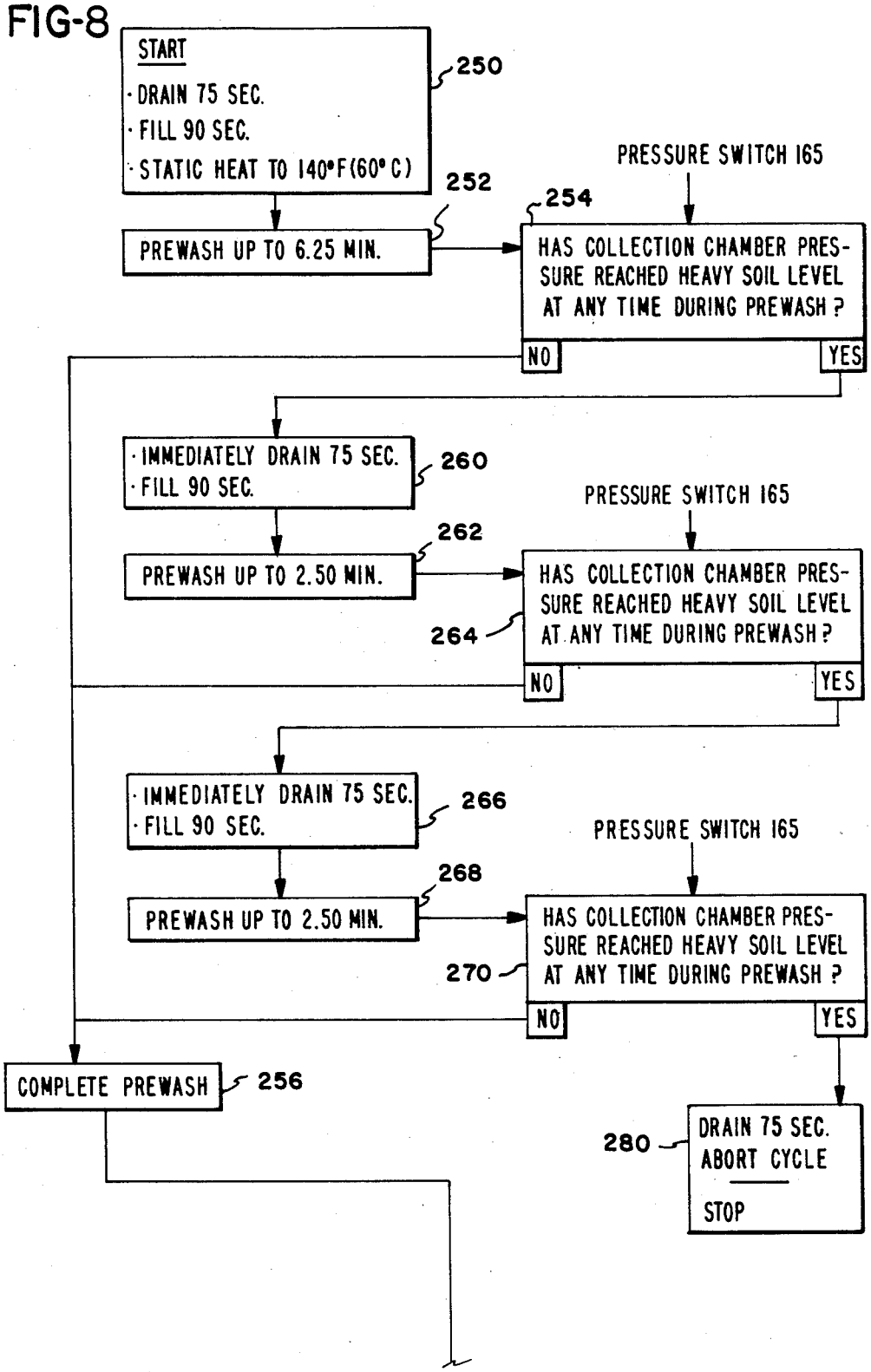
FIG. 8 is a block diagram showing the operation of the wash cycle of the dishwasher.
Figure 8:
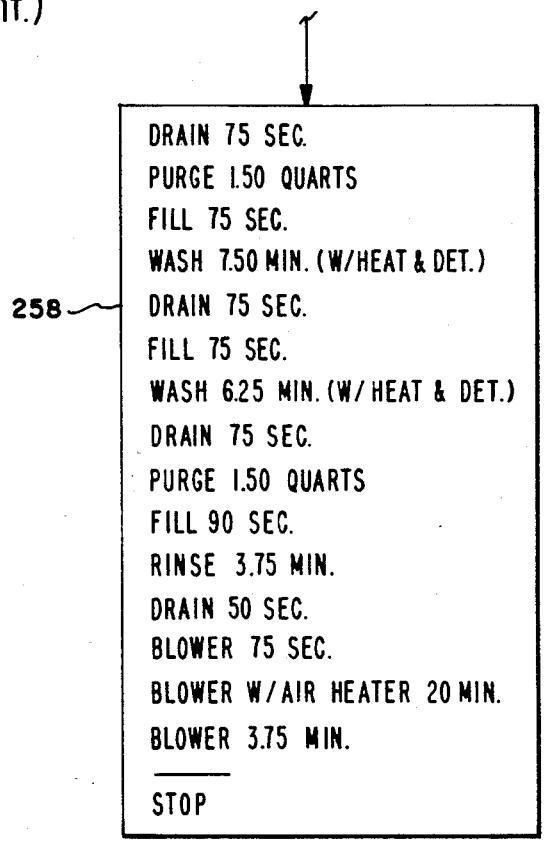

The operation of the improvement of the present invention is shown diagrammatically in FIG. 8, which illustrates, in flow-chart fashion, the operation of the "Wash" cycle. It will be understood that the operation of pressure switch 165 and the resulting selection of the proper number of prewashes is substantially similar for either the "Sani Cycle" or "Rinse & Hold" cycles.

Upon starting the cycle, as shown at block 250 in FIG. 8, a 75-second drain is performed by energizing motor 68 through cam switches C12B and C11T to remove any fluid that may be present within the sump 56. A 90-second fill of sump 56 is then performed by activating fill valve 230 at increments T2 and T3 through cam switches C10T and C13T. After filling, water in sump 56 is heated by water heaters 216 and 218. During heating, at increment T4, cam switch C4T is opened, deenergizing timer motor 170. Cam switch C1B is closed, so that when water temperature reaches 140° F.(60° C.), thermostat 226 will close, reenergizing timer motor 170, thereby ascertaining that water temperature is at least 140°(60° C.). Cam switches C12B and C11B are closed at increment T5, and motor 68 begins circulating water onto the ware by driving pump 65, seen as a prewash in block 252. Simultaneously, pump 66, also driven by motor 68, begins circulating water and accumulated soil through the soil collecting chamber 120.

As soil is collected within collection chamber 120, pressure within chamber 120 increases. If, however, as shown at block 254, the pressure does not rise to a level sufficient to activate pressure switch 165, contact member 204 remains in contact with terminal 206. The circulation of water by pump 65 continues for a period of $6\frac{1}{4}$ minutes, block 256, with cam switch C2T being closed for the final 75 seconds of this period, shown at increment T9 in FIG. 6. Heater 212 of thermal relay switch 210 is thus energized, closing bi-metal switch 214. Cam switch C3T closes in the following increment, thereby energizing rapid advance motor 172 to advance the timer past two extra prewashes to increment T18, wherein the sump 56 is drained by pump 66, driven by motor 68 which is energized by cam switches C14B and C11T. The remainder of the cycle then follows as shown in block 258 in FIG. 8.

If at any time during the $6\frac{1}{4}$ minute prewash the pressure within collection chamber 120 rises to a level sufficient to activate pressure switch 165, seen at block 254, contact member 204 will be moved into contact with terminal 208. Since cam switch C6T is closed during the entire prewash, rapid advance motor 172 is energized to move the timer ahead to increment T10. Motor 68 is then energized by cam switches C14B and C11T, driving pumps 65 and 66, thereby flushing soil from collection chamber 120 and draining soil and water from sump 56, shown at block 260 in FIG. 8.

Upon completion of the drain, sump 56 is refilled by fill valve 230 and a second, $2\frac{1}{2}$-minute prewash begins, indicated at block 262. If, as shown at block 264, the soil collected in chamber 120 is insufficient to cause the pressure therein to activate pressure switch 165, then, as with the first prewash, cam switch C2T closes for the final 75 seconds of the prewash, shown at increment T13 in FIG. 4. Heater 212 of thermal relay switch 210 is energized, closing bi-metal switch 214. Cam switch C3T closes in the following increment, energizing rapid advance motor 172 to advance the timer to increment T18. Sump 56 is drained, and the remainder of the cycle follows as shown in block 258 in FIG. 8.

If, however, at any time during the second prewash the pressure in collection chamber 120 becomes sufficient to activate pressure switch 165, seen at block 264, contact member 204 will again be moved into contact with terminal 208. Since cam switch C6T is closed during the entire second prewash, the rapid advance motor 172 is immediately energized to move the timer ahead to increment T14. Motor 68 is then energized by cam switches C14B and C11T, driving pumps 65 and 66, thereby flushing soil from collection chamber 120 and draining soil and water from sump 56, shown at block 266 in FIG. 8.

Upon completion of the drain, sump 56 is refilled by fill valve 230, and a third, $2\frac{1}{2}$-minute prewash begins, indicated at block 268. If, as shown in block 270, the pressure within chamber 120 is insufficient to activate pressure switch 165, the entire prewash is carried out, block 256, bringing the timer to increment T18. The sump 56 is drained, and the remainder of the cycle follows as shown in block 254 in FIG. 8.

If at anytime during the third prewash the pressure in collection chamber 120 becomes sufficient to activate pressure switch 165, contact member 204 will be moved into contact with terminal 208. Cam switch C6T is closed during the entire third prewash, so rapid advance motor 172 is energized to move the timer ahead to increment T18. Motor 68 is energized by cam switches C14B and C11T, driving pumps 65 and 66, thereby flushing soil from collection chamber 120 and draining soil and water from sump 56.

Normally, three prewashes should be more than sufficient to remove even an abnormally high quantity of soil from the food ware within the wash chamber 55. Accordingly, in the event pressure switch 165 is activated during the third prewash, it is far more likely to be due to a malfunction in the soil collection circuit, such as for instance complete blockage of the filter mesh 130, than due to a general high soil level within wash chamber 55.

Thus, during the third prewash, as seen in FIG. 6, cam switch C2B is closed. If at any time during the prewash pressure switch 165 is activated, seen at block 270, closure of contact member 204 and terminal 208 will in addition energize through cam switch C2B coil 272 of relay 274. As shown in FIG. 4, relay 274 is a double-pole, single-throw normally open relay having a pair of contacts 276 and 278. Energization of coil 272 closes contacts 276 and 278, with contact 276 connected in series with coil 272 so that once energized, coil 272 will remain so until deenergized by opening of the door of the dishwasher 50, opening switch 196.

After draining of sump 56, at increment T18 and as shown at block 280 of FIG. 8, cam switch C6B is closed at increment T19. Rapid advance motor 172 is energized through contact 278 of relay 274 and cam switch C6B, and advances the timer past the remainder of the dishwasher cycle, bypassing all subsequent operations and thereby aborting the cycle.

Simultaneously with energization of relay coil 272, an indicator light 282 or other appropriate display device is activated, remaining so until the door of the dishwasher 50 is opened, to alert the operator of the dishwasher 50 that the cycle has been aborted.

While the form of apparatus herein described constitutes a preferred embodiment of the invention, it is to be understood that the invention is not limited to this precise form of apparatus, and that changes may be made therein without departing from the scope of the invention, which is defined in the appended claims.

What is claimed is:

1. In a multiple-fill dishwasher including a wash chamber having, a sump at the bottom thereof, means including a remotely controlled inlet valve for supplying cleansing liquid into said sump, means for draining liquid and entrained soil from said sump, a recirculating pump having an intake adjacent the bottom of said sump and a spraying system receiving the output of said pump for spraying cleansing liquid onto soiled ware contained within said chamber, control means connected to control said valve, said drain means, and said pump to perform a selected one of a plurality of different cleansing cycles which are automatically selected according to the extent of soil on the ware to be washed, and an operator-actuated switch means for commencing operating of the control means, the improvement comprising:

a sensor means responsive to a predetermined or greater particulate soil concentration in the cleansing liquid during liquid recirculation, means operated by said sensor means during liquid recirculation in response to said predetermined or greater soil concentration to cause said control means to select a cycle designed to wash heavily soiled ware, and means operated by said sensor means in response to less than said predetermined soil concentration at a predetermined time in an early part of the dishwasher's operation to select a cleansing cycle designed to wash lightly soiled ware.

2. In a multiple-fill dishwasher including a wash chamber having a sump at the bottom thereof, means including a remotely controlled inlet valve for supplying cleansing liquid into said sump, means for draining liquid and entrained soil from said sump, a recirculating pump having an intake adjacent the bottom of said sump and a spraying system receiving the output of said pump for spraying cleansing liquid onto soiled ware contained within said chamber, control means connected to control said valve, said drain means, and said pump to perform a selected one of a plurality of different cleansing cycles which are automatically selected according to the extent of soil on the ware to be washed, an operator-actuated switch means for commencing operating of the control means, and means for collecting soil particles in concentrated fashion during recirculation of the cleansing liquid, the improvement comprising:

a sensor responsive to a predetermined or greater particulate soil concentration in said soil collecting means during liquid recirculation, means operated by said sensor during liquid recirculation in response to reaching or surpassing said predetermined soil concentration within said soil collecting means during a predetermined period in an early part of the dishwasher's operation to cause said control means to select a cycle designed to wash heavily soiled ware, and means operated by said sensor means in response to less than said predetermined soil concentration within said soil collecting means during said predetermined period to cause said control means to select a cleansing cycle designed to wash lightly soiled ware.

3. A dishwasher according to claim 2 wherein said means for collecting soil particles includes a fine-mesh filter, and wherein said sensor senses a predetermined impeded flow through said filter to actuate one of said selecting means for heavily or lightly soiled ware.

4. A dishwasher according to claim 3 wherein said means for collecting soil particles further includes a conduit through which liquid is circulated and directed through said filter, and wherein said sensor senses at least a predetermined minimum pressure variation on an upstream side of said filter indicative of an impeded flow condition in order to select the cycle for heavily soiled ware.

5. A dishwasher according to claim 4 wherein said means for collecting soil particles further includes a collection pump having an inlet adjacent the bottom of said sump for pumping liquid with entrained soil particles into said conduit, such that said means for collecting soil particles is independent from said recirculating pump and said spraying system.

6. A dishwasher according to claim 4 wherein said sensor senses less than said minimum pressure variation on said upstream side of said filter to indicate an unimpeded flow condition in order to select the cycle for lightly soiled ware.

7. A dishwasher according to claim 6 wherein said sensor is a pressure sensor in communication with said conduit.

8. A dishwasher according to claim 2 wherein said means for collecting soil particles includes a soil collection chamber, and said sensor means is responsive to particulate soil buildup in said collection chamber.

9. A dishwasher according to claim 8 wherein said means for collecting soil particles further includes a conduit through which liquid is circulated into and through said collection chamber, and a fine-mesh filter through which liquid passes out of said collection chamber.

10. A dishwasher according to claim 9 wherein said sensor senses a clogging or unclogged condition of said filter to respectively select said cycles for heavily or lightly soiled ware.

11. A dishwasher according to claim 8 wherein said sensor is a pressure sensor in communication with said collection chamber.

12. A dishwasher according to claim 9 wherein said means for collecting soil particles further includes a collection pump having an inlet adjacent the bottom of said sump for pumping liquid with entrained soil particles into said conduit, such that said means for collecting soil particles is independent from said recirculating pump and said spraying system.

13. In a multiple-fill dishwasher including a wash chamber having a sump at the bottom thereof, means including a remotely controlled inlet valve for supplying cleansing liquid into said sump, means for draining liquid and entrained soil from said sump, a recirculating pump having an inlet adjacent the bottom of said sump and a spraying system receiving the output of said pump for spraying cleansing liquid onto soiled ware contained within said chamber, control means connected to control said valve, said drain means, and said pump to perform a selected one of a plurality of different cleansing cycles which are automatically selected according to the extent of soil on the ware to be washed, an operator-actuated switch means for commencing operating of the control means, and means including a soil collection chamber for collecting soil particles in concentrated fashion during recirculation of the cleansing liquid, the improvement comprising:

sensor means responsive to a predetermined or greater particulate soil concentration in said collection chamber during liquid recirculation, and means operated by said sensor means during liquid recirculation in response to reaching or surpassing said predetermined soil concentration within said collection chamber to actuate said control means to cause said drain means to drain said sump, and subsequently, said valve to refill said sump.

14. A dishwasher according to claim 13 wherein said means for collecting soil particles further includes a fine-mesh filter disposed within a fluid outlet defined within said collection chamber, and wherein said sensor senses a predetermined impeded flow through said filter to cause said control means to drain said sump.

15. A dishwasher according to claim 14 wherein said sensor senses at least a predetermined minimum pressure variation on an upstream side of said filter to indicate an impeded flow condition in order to drain said sump.

16. A dishwasher according to claim 15 wherein said sensor is a pressure sensor in communication with said collection chamber.

17. A dishwasher according to claim 16 wherein said pressure sensor comprises a pressure chamber disposed within said collection chamber and having a closed top and open bottom, a tube extending downwardly from said pressure chamber with the upper end of said tube disposed within said pressure chamber at a level above the maximum fluid level therein, said tube passing through said collection chamber and said sump, and a pressure switch communicating with the lower end of said tube and responsive to a pressure variation within said tube and the upper portion of said pressure chamber.

* * * * *